US006481749B2

(12) United States Patent
Ahlers et al.

(10) Patent No.: US 6,481,749 B2
(45) **Date of Patent: *Nov. 19, 2002**

(54) AUTO-UP SWITCH FOR SIMULTANEOUSLY RETRACTING A PAIR OF STABILIZER LEGS ON A BACKHOE LOADER MACHINE

(75) Inventors: Kem D. Ahlers, Apex, NC (US); Robert Q. Elliott, Raleigh, NC (US); John E. Francis, Raleigh, NC (US); Gerald L. Graf, Cary, NC (US); Kenneth J. McGuire, Garner, NC (US); Terry A. Moore, Apex, NC (US)

(73) Assignee: Caterpillar Inc, Peoria, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/314,728

(22) Filed: May 18, 1999

(65) Prior Publication Data

US 2002/0060450 A1 May 23, 2002

(51) Int. Cl.[7] ..... B60S 9/02; B66C 23/80

(52) U.S. Cl. ..... 280/764.1; 280/763.1; 212/304; 212/305

(58) Field of Search ..... 280/763.1, 764.1, 280/765.1, 766.1, 6.153; 212/304, 305

(56) References Cited

U.S. PATENT DOCUMENTS

| | | | | |
|---|---|---|---|---|
| 3,442,531 A | | 5/1969 | Rutledge | 280/150.5 |
| 3,523,698 A | | 8/1970 | Bishop | 280/150.5 |
| 3,550,506 A | * | 12/1970 | Gardenhour | 280/763.1 |
| 3,764,162 A | | 10/1973 | Rawlings | 280/150.5 |
| 3,912,288 A | | 10/1975 | F'Geppert | 280/6 H |
| 4,124,226 A | | 11/1978 | Phillips | 280/765 |
| 4,288,196 A | | 9/1981 | Sutton, II | 414/699 |
| 4,394,912 A | | 7/1983 | Epps et al. | 212/189 |
| 4,466,637 A | | 8/1984 | Nelson | 280/766.1 |
| 4,515,520 A | | 5/1985 | Parquet et al. | |
| 4,596,404 A | | 6/1986 | F'Geppert | 280/764.1 |
| 4,863,184 A | | 9/1989 | Mena | 280/475 |
| 5,056,985 A | * | 10/1991 | Johnson et al. | 414/694 |
| 5,575,493 A | * | 11/1996 | Schwartz et al. | 280/475 |
| 5,580,095 A | * | 12/1996 | Fukumoto | 280/840 |
| 5,698,907 A | * | 12/1997 | Weber | 307/10.1 |
| 5,723,959 A | * | 3/1998 | Iwata et al. | 318/447 |
| 5,988,654 A | * | 11/1999 | Wix et al. | 280/6.15 |
| 5,992,883 A | * | 11/1999 | Lagsdin | 280/763.1 |
| 6,076,855 A | * | 6/2000 | Webb | 280/765.1 |

FOREIGN PATENT DOCUMENTS

| | | |
|---|---|---|
| EP | 0 741 209 A2 | 11/1996 |
| EP | 0 741 209 A3 | 5/1997 |

* cited by examiner

*Primary Examiner*—Brian L. Johnson
*Assistant Examiner*—Jeff Restifo
(74) *Attorney, Agent, or Firm*—Diane L Charlton

(57) ABSTRACT

Automatic and simultaneous retraction of a pair of stabilizer legs for a backhoe loader machine 10 is beneficial for the operator when operation of the backhoe loader is complete. Instead of retracting the stabilizer legs by manually holding a pair of control switches continuously in a control position, the operator may simply push an auto-up switch with a single, "one-touch" contact. Once the auto-up switch has been activated by the "one-touch" contact, a timer relay is enabled. The timer relay acts independently of the auto-up switch to control the simultaneously retraction of the stabilizer legs without any further contact to the auto-up switch. When the timer relay is enabled, it sends a signal to activate the control switches for a preselected time. The activation of the control switches actuates a pair of solenoid valves which control the movement of the stabilizer legs from any one of a plurality of extended positions to a fully retracted position within the preselected time.

15 Claims, 5 Drawing Sheets

AUTO-UP SWITCH FOR SIMULTANEOUSLY RETRACTING A PAIR OF STABILIZER LEGS ON A BACKHOE LOADER MACHINE

TECHNICAL FIELD

This invention relates generally to a mechanism for retracting a pair of stabilizer legs for a backhoe loader machine and more particularly to the ability to simultaneously retract the pair of stabilizer legs with a single switch from an extended position to a fully retracted position.

BACKGROUND ART

It is well known that a machine, such as a backhoe loader, is used to dig ditches, foundations, basements, and the like. During such machining operations, the backhoe loader machine utilizes a pair of stabilizer legs to maintain a steady and solid working foundation. The foundation is established when the pair of stabilizer legs are extended either individually or together by separate and continuous activation of a pair of control switches. Each one of the pair of control switches is coupled with a respective one of the pair of stabilizer legs and the amount of stabilizer leg extension depends on the surrounding terrain. Generally, upon completion of machining operations, the pair of stabilizer legs are retracted through the separate and continuous activation of the pair of control switches. The ability to retract both of the stabilizer legs simultaneously without continuous operation of the pair of control switches, however, would be beneficial for an operator due to an ease in operation.

A design disclosed in U.S. Pat. No. 4,124,226 issued to Frank T. Phillips on Nov. 7, 1978 utilizes four hydraulically operated outrigger assemblies on a mobile crane. A control system is provided for operating the eight cylinders to extend, retract, and lower and raise the outriggers through actuation of horizontal and vertical stabilizer cylinders, respectively. Simultaneous extension or retraction of the outrigger assemblies is achieved by the continuous operation of various switches in combination. Unfortunately, the ability to simultaneously retract the outrigger assemblies through a single switch that does not require continuous operation is not disclosed. The ability to simultaneously retract the outrigger assemblies in such a manner would improve operator flexibility by lessening the time and energy normally spent on retracting the outrigger assemblies.

The present invention is directed to overcoming the problems as set forth above.

DISCLOSURE OF THE INVENTION

In one aspect of the present invention, a method is disclosed for individually extending and simultaneously retracting a pair of stabilizer legs for a work machine. The work machine has a control device for selecting forward or reverse directions of movement for the work machine and is operatively associated with a power source. The method comprises the steps of activating a pair of control switches in communication with the power source. One of the pair of control switches is operatively associated with a respective one of a pair of stabilizer legs for individually moving the stabilizer legs from a retracted position to an extended position. Then, activating a singular auto-up switch in communication with the power source. The auto-up switch is operatively associated with the pair of stabilizer legs for moving both of the pair of stabilizer legs simultaneously from the extended position to the retracted position.

In another aspect of the invention, a work machine has front and rear end portions, a control panel disposed within an interior of the work machine, a pair of stabilizer legs connected to the rear end portion, a hydraulic cylinder operatively associated with each of the pair of stabilizer legs for moving the stabilizer legs in a plurality of positions between fully extended and fully retracted. The work machine is capable of movement in forward or reverse directions and has a control device for selecting the forward or reverse direction. The invention comprises a pair of control switches located on the control panel that are operatively associated with a respective one of the pair of stabilizer legs. The pair of control switches are adapted through activation for actuating the hydraulic cylinders individually to move the stabilizer legs from any one of the plurality of retracted positions to any one of the plurality of extended positions. A singular auto-up switch is located on the control panel and is operatively associated with the pair of stabilizer legs. The auto-up switch is adapted through activation for actuating the pair of hydraulic cylinders simultaneously to move both of the pair of stabilizer legs from the any one of the plurality of extended positions to the fully retracted position.

The present invention includes the ability to simultaneously retract a pair of stabilizer legs for a work machine through a single, auto-up switch. The simultaneous and automatic retraction of the pair of stabilizer legs increases ease of operation and operator flexibility.

BEST MODE FOR CARRYING OUT THE INVENTION

Figure 1:
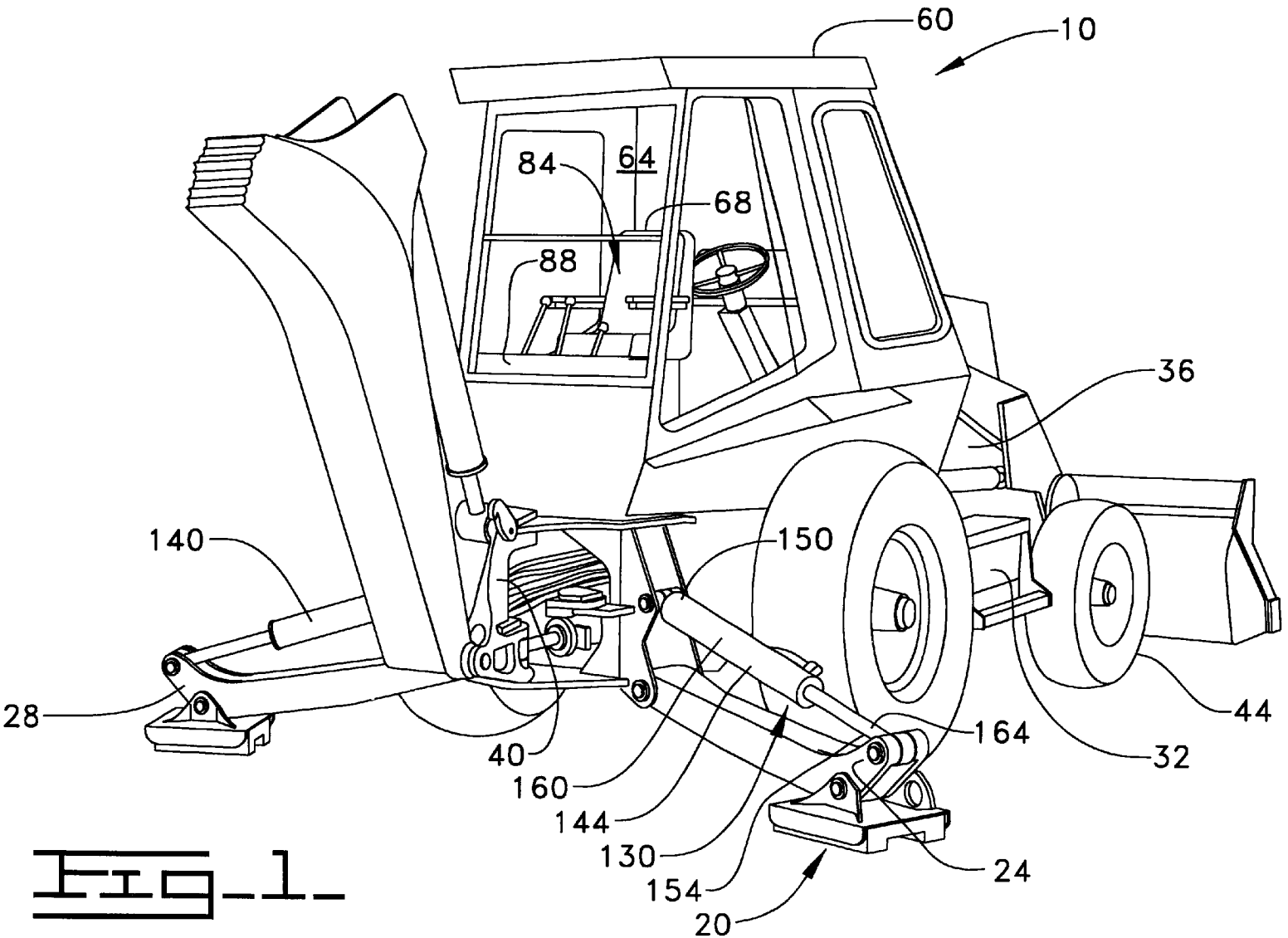
FIG. 1 is a side elevational view of a backhoe loader machine having an extension and retraction system for a pair of stabilizer legs in accordance with the present invention and depicting the stabilizer legs in an extended position.
Figure 2:
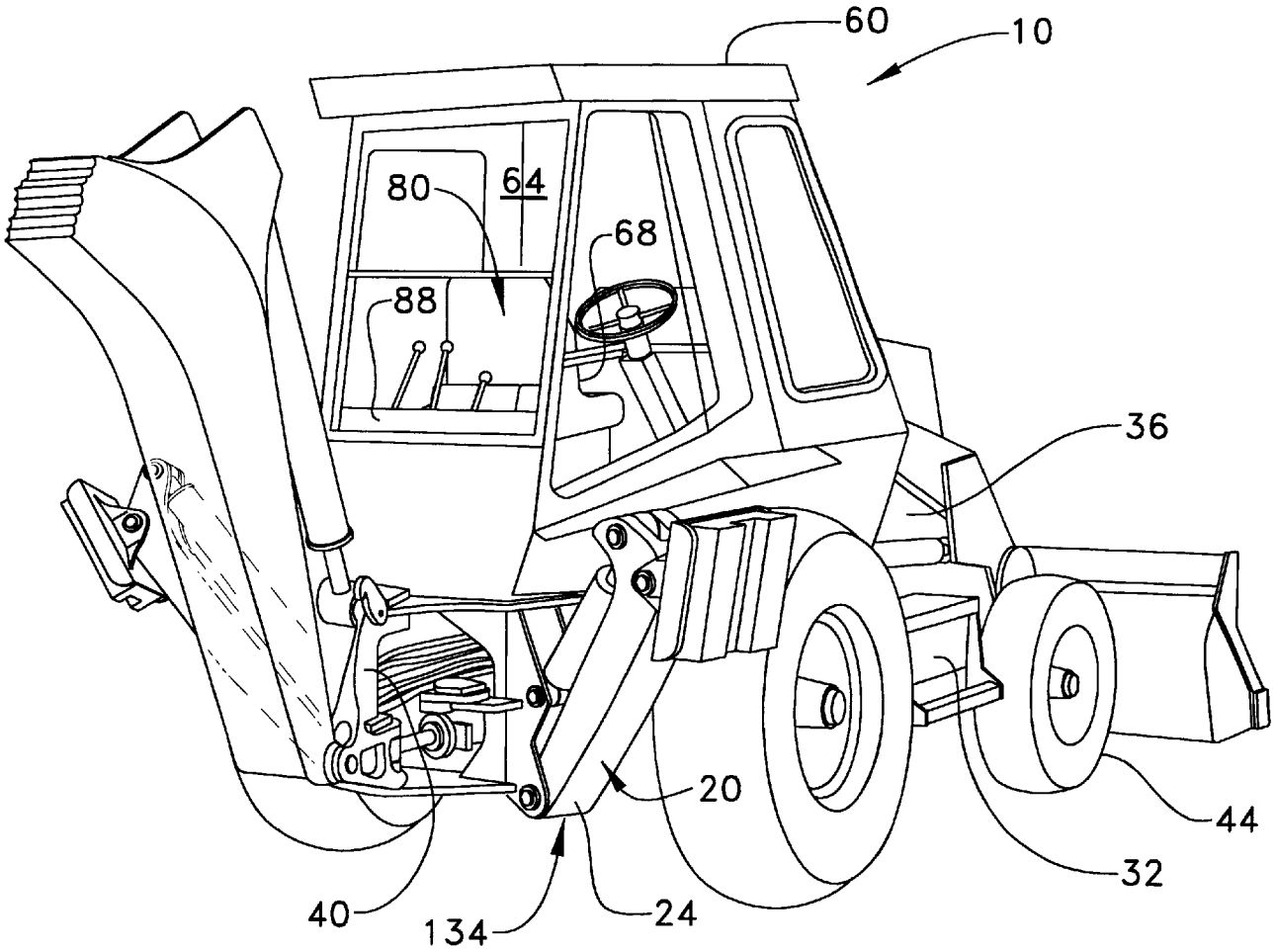
FIG. 2 is a side elevational view of the backhoe loader machine of FIG. 1 depicting the stabilizer legs in a fully retracted position.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 3:
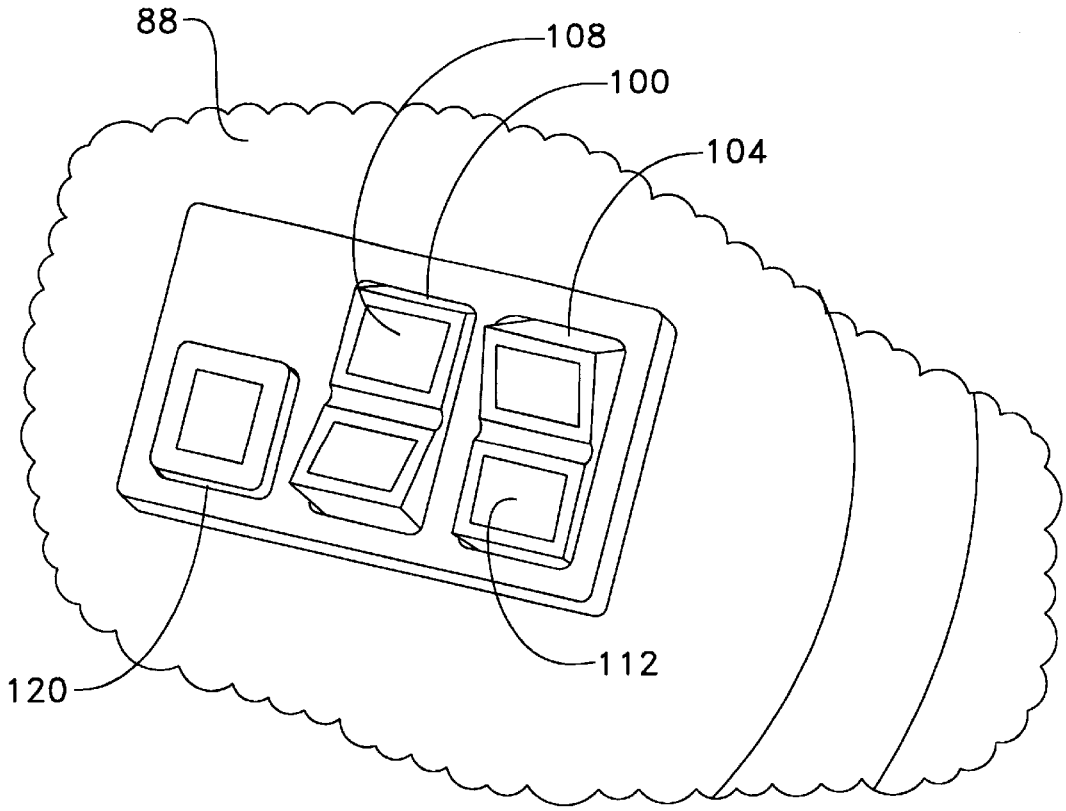
FIG. 3 is an enlarged perspective view of a portion of a control panel within the interior of a cab for the backhoe loader machine of FIG. 1.
Figure 4:
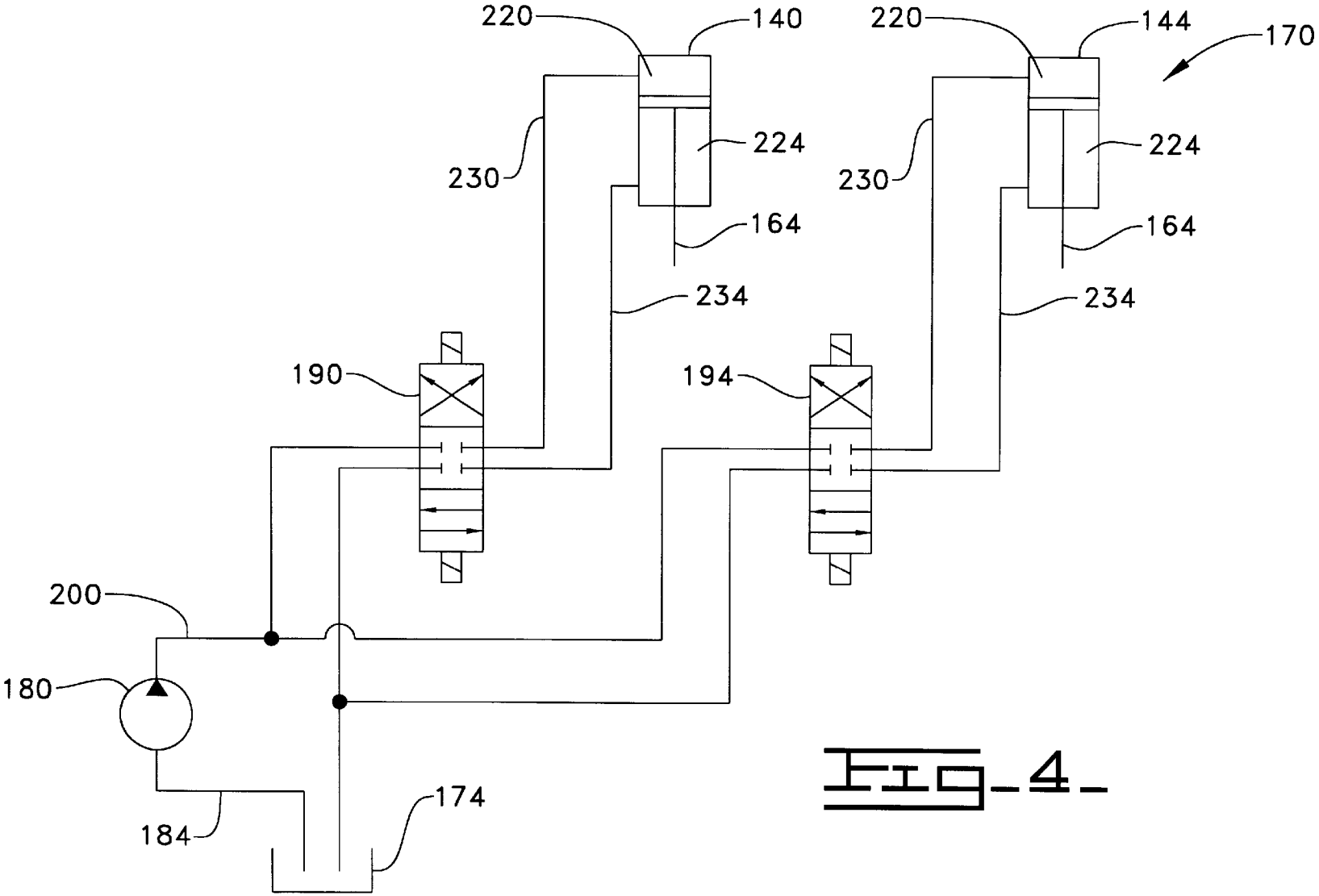
FIG. 4 is an enlarged hydraulic schematic showing the hydraulic operation of the extension and retraction system in detail and in accordance with the present invention.
Figure 5:
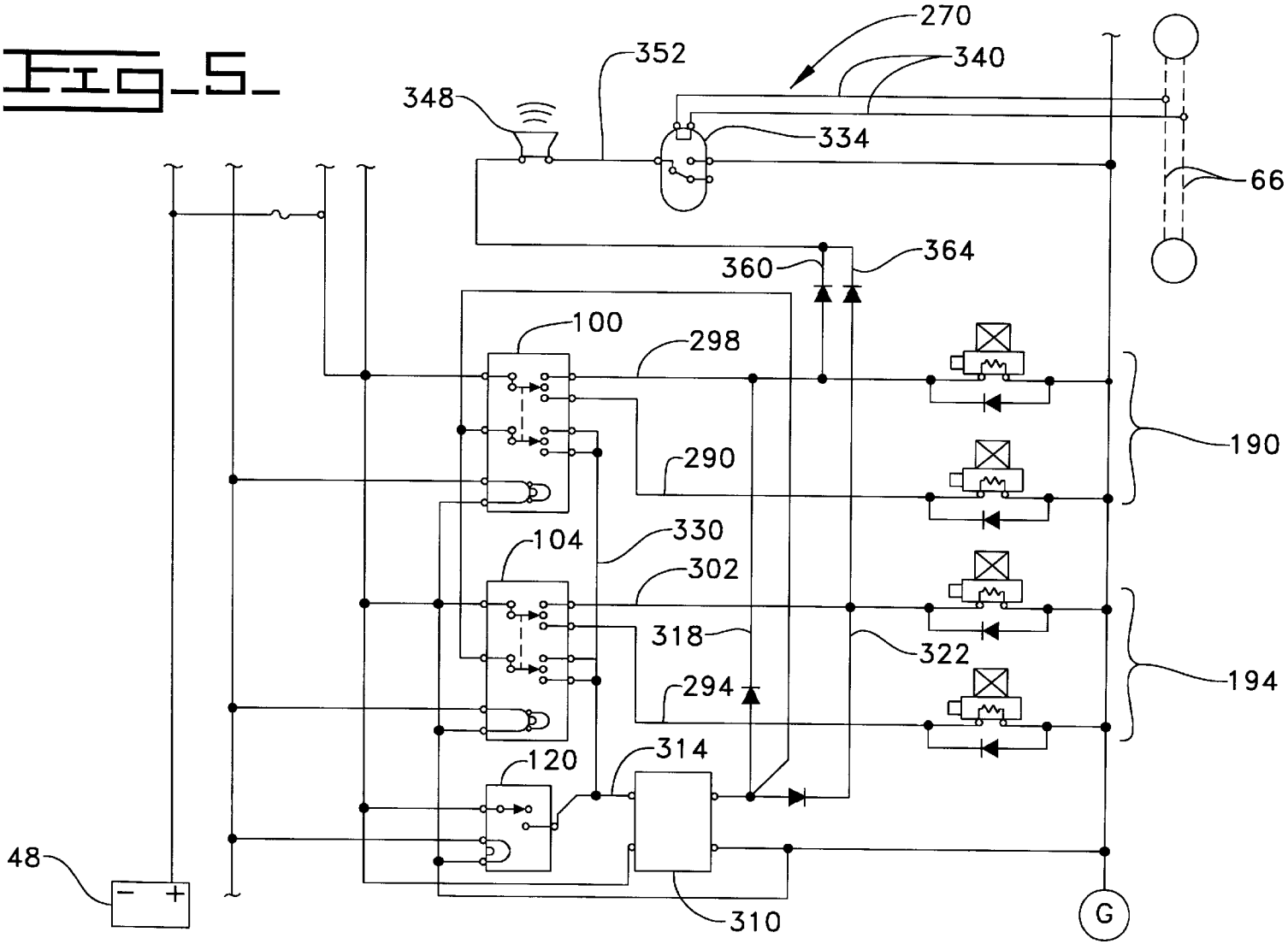
FIG. 5 is a schematic diagram of the electrohydraulic extension and retraction system for the backhoe loader machine of FIG. 1 in accordance with the present invention.

Referring to FIGS. 1–5, a work machine 10, such as a backhoe loader, is shown incorporating an extension and retraction system 20 for a pair of stabilizer legs 24,28. Although the present invention is shown in operative association with a backhoe loader, it should be understood that the present invention may be incorporated on any suitable work machine 10. Looking more closely at FIGS. 1–2, the backhoe loader 10 includes a machine frame 32 with front and rear end portions 36,40 supported for travel by a plurality of wheels, one of which is shown at 44. An electrical power source 48, such as a battery, is disposed within the frame 32 of the backhoe loader 10 and is shown schematically on FIG. 5. A cab 60 is mounted on the frame 32 in a well-known manner and has an interior portion 64. A control device 66, shown schematically in FIG. 5, is disposed within the interior portion 64 to allow the operator (not shown) to select either forward or reverse directions of movement for the backhoe loader 10. It should be understood that the control device 66 may be of any suitable design for actuating either a standard or automatic transmission of the backhoe loader 10. The interior portion 64 includes a seat 68 therein for occupation by the operator (not shown). The seat 68 swivels between front and rear positions 80,84, the rear position 84 being shown in FIG. 1. When the seat 68 is in the rear position 84, it faces a rear control panel 88, a portion of which is shown in FIG. 3. The rear control panel 88 is connected in a well-known manner within the interior portion 64 of the cab 60. As seen in FIG. 3, a pair of control switches 100,104 of any suitable type, such as spring-loaded toggle switches, capable of movement to upper and lower control positions 108,112 are mounted on the rear control panel 88. A single, auto-up switch 120 of any suitable type, such as a push button spring-loaded switch, is mounted adjacent one of the pair of control switches 100. It should be understood that the control switches 100,104 and the auto-up switch 120 may be mounted on any suitable structure within the interior portion 64 of the cab 60. It should also be understood that the control switches 100,104 or the auto-up switch 120 may be incorporated together or separately to achieve the same function. The control switches 100,104 and auto-up switch 120 are connected for activation to the electrical power source 48 in a well-known manner.

Referring again to FIGS. 1–2, the pair of stabilizer legs 24,28 are secured on the rear end portion 40 of the frame 32 in a conventional manner. The stabilizer legs 24,28 are movable between a fully extended position 130 and a fully retracted position 134 (the fully retracted position 134 being shown in FIG. 2). It should be understood that the stabilizer legs 24,28 may be positioned at any one of a plurality of positions along the fully extended and fully retracted positions 130,134. The movement of the stabilizer legs 24,28 is accomplished through a pair of hydraulic cylinders 140,144. Each of the pair of hydraulic cylinders 140,144 are connected in a well-known manner at a first end 150 to the frame 32 and at a second end 154 to a respective one of the pair of stabilizer legs 24,28. The hydraulic cylinders 140,144 may be of any suitable type, but preferably double actuated. The double actuated hydraulic cylinders 140,144 each include a housing 160 with a piston and rod assembly 164 therein, seen more clearly in FIG. 1 and also diagrammatically in hydraulic circuit 170 of FIG. 4.

The hydraulic circuit 170 of FIG. 4 includes a reservoir 174 for holding a quantity of hydraulic fluid. The reservoir 174 is connected to a pump 180 via line 184. The pump 180 may be of any suitable type capable of pressurizing the hydraulic fluid. The pump 180 is connected to a pair of solenoid valves 190,194 via line 200. The solenoid valves 190,194 may be of any suitable type but capable of actuation from a normally closed position (not shown) to either a first or second open position (not shown). Each of the solenoid valves 190,194 includes a control valve (not shown) therein and is connected to a respective one of the pair of hydraulic cylinders 140,144. The piston and rod assembly 164, normally disposed at a mid-position, is capable of moving the stabilizer legs 24,28 between the extended and retracted positions 130,134 dependent upon the introduction of pressurized hydraulic fluid into either upper or lower portions 220,224 of the hydraulic cylinders 140,144 through lines 230,234, respectively, in response to movement of the control valves (not shown) to either of the first or second open positions (not shown) in a well-known manner. It should be understood that although the solenoid valves 190,194 shown have two open positions respectively connected to the upper and lower portions 220,224 of the hydraulic cylinders 140,144 to facilitate the extension and retraction of the stabilizer legs 24,28, two separate solenoid valves could be utilized to achieve the same function.

Referring more particularly to an electrical circuit 270 for the extension and retraction system 20, shown in FIG. 5, the pair of control switches 100,104 and auto-up switch 120 are shown schematically in communication with the electrical power source 48. Each of the control switches 100,104 are coupled to a respective solenoid valve 190,194 via extension and retraction lines 290,294,298,302, respectively. It should be understood that four solenoid valves are shown in FIG. 5 to clarify the separate extension and retraction circuits of each of the stabilizer legs 24,28. A timer relay 310 is shown coupled via input line 314 to the auto-up switch 120 and coupled via output lines 318,322 to each of the control switches 100,104, respectively. Further, the control switches 100,104 are coupled to the timer relay 310 through input line 330 which is operative with input line 314 from the auto-up switch 120. The control device 66 is connected to an alarm relay 334 through output lines 340. The alarm relay 334 is coupled to an alarm device 348 via line 352. The pair of control switches 100,104 are coupled to the alarm device 348 via output lines 360,364, respectively. It should be understood that the electrical circuit 270 is connected in a conventional manner to a ground G. Further, lighting for the rear control panel 88 is shown schematically in FIG. 5 but not described in detail. It should also be understood that although a timer relay 310 is described, any suitable time delay mechanism, such a pressure or limit switch (not shown), may be utilized without extending beyond the scope of the present invention.

Industrial Applicability

Prior to operation of the backhoe loader 10 for digging, trenching, and the like, the operator (not shown) will generally stabilize the backhoe loader 10 by extending the stabilizer legs 24,28 into contact with the surrounding terrain. To accomplish that purpose, the operator (not shown) will manually hold the control switches 100,104, either singularly or together, in the lower control position 112 until the desired extension is obtained. The movement of the control switches 100,104 to the lower control position 112 activates the control switches 100,104 to actuate the solenoid valves 190,194 to the first open position in a conventional manner. The first open position of the solenoid valves 190,194 allows hydraulic fluid from the reservoir 174 to move through the pump 180. The pump 180 pressurizes the hydraulic fluid for entry through the solenoid valves 190,194 and into the upper portion 220 of the hydraulic cylinders 140,144, thus extending the stabilizer legs 24,28. The retraction of the stabilizer legs 24,28 may also be accomplished through the control switches 100,104. To accomplish that purpose, the operator (not shown) will manually hold the control switches 100,104, either singularly or together, in the upper control position 108 until the desired retraction is obtained. As described previously, the movement of the control switches 100,104 to the upper control position 108 activates the control switches 100,104 to actuate the solenoid valves 190,194 to the second open position. Conversely, pressurized hydraulic fluid flows through the solenoid valves 190,194 and into the lower portion 224 of the hydraulic cylinders 140,144 for retracting the stabilizer legs 24,28.

Automatic and simultaneous retraction of the stabilizer legs 24,28 is beneficial for the operator (not shown) when operation of the backhoe loader 10 is complete. Instead of retracting the stabilizer legs 24,28 manually by holding the control switches 100,104 in the upper control position 108, the operator (not shown) may simply push the auto-up switch 120 with a single, "one-touch" contact to initialize activation. The "one-touch" contact of the auto-up switch 120 removes the requirement of manually holding a switch continuously throughout the retraction of the stabilizer legs 24,28. Once the auto-up switch 120 has been activated, the timer relay 310 is enabled. Thereafter, the timer relay 310 acts independently of the auto-up switch 120 to control the simultaneous retraction of the stabilizer legs 24,28 without any further contact to the auto-up switch 120. This is accomplished when the timer relay 310 is enabled by a primary signal from the auto-up switch 120. The timer relay 310 then sends a signal to activate the control switches 100,104 for a preselected time, preferably greater than the total time necessary to fully retract the stabilizer legs 24,28 from the fully extended position 130. The activation of the control switches 100,104 actuates the solenoid valves 190, 194 into the second open position, allowing pressurized hydraulic fluid to flow simultaneously into the lower portions 224 of the hydraulic cylinders 140,144. The stabilizer legs 24,28 are moved completely to the fully retracted position 134 from any one of the plurality of extended positions within the preselected time. However, if either the control switches 100,104 or auto-up switch 120 is contacted by the operator (not shown) during the preselected time, the simultaneous retraction of the stabilizer legs 24,28 is interrupted. This occurs due to a secondary signal being sent from the control switches 100,104 or auto-up switch 120 during the preselected time that disables the timer relay 310. Further, if the operator (not shown) moves the control device 66 into gear during the preselected time, thus selecting the forward or reverse direction of movement for the backhoe loader 10, the alarm device 348 will sound. This occurs when the alarm device 348 is activated by a signal from both the control device 66, when selecting the forward or reverse direction of movement of the backhoe loader 10, and the timer relay 310, when enabled to control the simultaneous retraction of the stabilizer legs 24,28. It should be understood that the movement of the control device 66 into gear during retraction of the stabilizer legs 24,28, either by use of the control switches 100,104 or the auto-up switch 120, will cause activation of the alarm device 348.

Other aspects, objects and advantages of this invention can be obtained from a study of the drawings, disclosure and the appended claims.

What is claimed is:

1. A method of individually extending and simultaneously retracting a pair of stabilizer legs for a work machine, the work machine having a control device for selecting forward or reverse directions of movement for the work machine and being operatively associated with a power source, comprising the steps of:

activating a pair of control switches in communication with the power source, one of the pair of control switches being operatively associated with a respective one of a pair of stabilizer legs for individually moving the stabilizer legs from a retracted position to an extended position;

activating a singular auto-up switch in communication with the power source, the auto-up switch being operatively associated with the pair of stabilizer legs for moving both of the pair of stabilizer legs simultaneously from the extended position to the retracted position; and selecting the forward or reverse direction of the work machine subsequent to retraction of the stabilizer legs.

2. The method of individually extending and simultaneously retracting the pair of stabilizer legs of claim 1, wherein the step of activating the auto-up switch includes the step of:

contacting the auto-up switch in a single, non-continuous motion, the movement of both of the pair of stabilizer legs simultaneously from the extended position to the retracted position being independent of further contact with the auto-up switch after activation.

3. The method of individually extending and simultaneously retracting the pair of stabilizer legs of claim 1, including the steps of:

activating the auto-up switch through a single, non-continuous contact that automatically moves both of the pair of stabilizer legs simultaneously from the extended position to the retracted position, the movement of both of the pair of stabilizer legs being independent of the auto-up switch after the contact;

coupling a time delay mechanism with the auto-up switch so that the simultaneous retraction of the pair of stabilizer legs is completed within a preselected time; and activating either of the pair of control switches or the auto-up switch during the preselected time disables the time delay mechanism and interrupts the simultaneous retraction of the pair of stabilizer legs.

4. The method of individually extending and simultaneously retracting the pair of stabilizer legs of claim 3, including the step of:

selecting the forward or reverse direction of the work machine with the control device prior to the completion of the preselected time for simultaneously retracting the pair of stabilizer legs activates an alarm device coupled with the control device and time delay mechanism.

5. The method of individually extending and simultaneously retracting the pair of stabilizer legs of claim 1, wherein moving the stabilizer legs from the retracted position to the extended position includes the steps of:

actuating a pair of solenoid valves, one of the pair of solenoid valves being connected with a respective one of the pair of control switches and movable from a closed position to an open position by the activation of the control switches; and allowing a flow of pressurized hydraulic fluid to move from a pump to a first end of a pair of hydraulic cylinders through the actuation of the pair of solenoid valves to the open position, one of the hydraulic cylinders operative with a respective one of the pair of stabilizer legs to move the stabilizer legs from a retracted position to an extended position.

6. The method of individually extending and simultaneously retracting the pair of stabilizer legs of claim 5, wherein moving the stabilizer legs from the extended position to the retracted position includes the steps of:

actuating the pair of solenoid valves, the pair of solenoid valves being connected with the auto-up switch and movable from the closed position to the open position by the activation of the auto-up switch; and allowing the pressurized hydraulic fluid to move from the pump to a second end of the pair of hydraulic cylinders through the actuation of the pair of solenoid valves to the open position to move the stabilizer legs from an extended position to a retracted position.

7. A work machine having front and rear end portions, a control panel disposed within an interior of the work machine, a pair of stabilizer legs connected to the rear end portion, a hydraulic cylinder operatively associated with each of the pair of stabilizer legs for moving the stabilizer legs in a plurality of positions between fully extended and fully retracted, the work machine capable of movement in forward or reverse directions, comprising:

a pair of control switches located on the control panel and being operatively associated with a respective one of the pair of stabilizer legs and adapted through activation for actuating the hydraulic cylinders individually to move the stabilizer legs from any one of the plurality of retracted positions to any one of the plurality of extended positions;

a singular auto-up switch located on the control panel and being operatively associated with the pair of stabilizer legs and adapted through activation for actuating the pair of hydraulic cylinders simultaneously to move both of the pair of stabilizer legs from the any one of the plurality of extended positions to the fully retracted position; and a control device for selecting the forward or reverse drive condition of the work machine, the control device being selected subsequent to retraction of the stabilizer legs.

8. The work machine of claim 7, wherein the auto-up switch actuates the pair of hydraulic cylinders automatically when activated by a single, non-continuous contact, the movement of both of the pair of stabilizer legs being independent of further contact with the auto-up switch after activation.

9. The work machine of claim 8, including a time delay mechanism in communication with the auto-up switch, the time delay mechanism being responsive to the auto-up switch for controlling the completion of the simultaneous retraction of the pair of stabilizer legs within a preselected time.

10. The work machine of claim 9, wherein during the preselected time and in response to either of the pair of control switches or the auto-up switch the time delay mechanism interrupts the simultaneous retraction of the pair of stabilizer legs.

11. The work machine of claim 10, wherein the actuation of the hydraulic cylinders for moving the stabilizer legs from the any one of the plurality of extended positions to the fully retracted position is controlled through a hydraulic circuit including a pair of solenoid valves movable between open and closed positions and a pump in fluid communication with the pair of solenoid valves, both of the solenoid valves being connected to the auto-up switch and the time delay mechanism and adapted for actuation to the open position when the auto-up switch is activated.

12. The work machine of claim 7, wherein the auto-up switch is located separately from the pair of control switches.

13. The work machine of claim 7, wherein the auto-up switch is integral with the pair of control switches.

14. The work machine of claim 7, wherein actuation of the hydraulic cylinders for individually moving the stabilizer legs from the any one of the plurality of retracted positions to the any one of a plurality of extended positions is controlled through a hydraulic circuit including a pair of solenoid valves movable between open and closed positions and a pump in fluid communication with pair of solenoid valves, each of the solenoid valves being connected to a respective one of the pair of control switches and adapted for actuation to the open position when either of the pair of control switches is activated.

15. The work machine of claim 7, wherein the actuation of the hydraulic cylinders for simultaneously moving the stabilizer legs from the any one of the plurality of extended positions to the fully retracted position is controlled through a hydraulic circuit including a pair of solenoid valves movable between open and closed positions and a pump in fluid communication with pair of solenoid valves, both of the solenoid valves being connected to the auto-up switch and adapted for actuation to the open position when the auto-up switch is activated.

* * * * *